United States Patent [19]

Wells et al.

[11] Patent Number: 4,617,109

[45] Date of Patent: Oct. 14, 1986

[54] COMBUSTION AIR PREHEATING

[75] Inventors: Thomas A. Wells, Houston; William C. Petterson, Missouri City, both of Tex.

[73] Assignee: The M. W. Kellogg Company, Houston, Tex.

[21] Appl. No.: 812,546

[22] Filed: Dec. 23, 1985

[51] Int. Cl.[4] ..... C10G 9/20; C07C 4/04

[52] U.S. Cl. ..... 208/130; 208/132; 585/634; 585/648; 585/910; 585/914

[58] Field of Search ..... 208/130, 106, 132, 48 Q; 585/648, 650, 634, 910, 911, 914

[56] References Cited

U.S. PATENT DOCUMENTS

| | | | |
|---|---|---|---|
| 3,392,211 | 7/1968 | Buschmann et al. | 585/911 |
| 3,738,103 | 6/1973 | Rudolph et al. | 208/130 |
| 3,765,167 | 10/1973 | Rudolph et al. | 208/130 |
| 4,107,226 | 8/1978 | Ennis, Jr. et al. | 585/634 |
| 4,479,869 | 10/1984 | Petterson | 585/648 |

*Primary Examiner*—Andrew H. Metz
*Assistant Examiner*—Anthony McFarlane

[57] ABSTRACT

Combustion air for steam cracking furnaces is preheated by indirect heat exchange with medium pressure and low pressure steam that has been expanded through steam turbines from high pressure steam produced in the hot section of an ethylene production plant.

6 Claims, 1 Drawing Figure

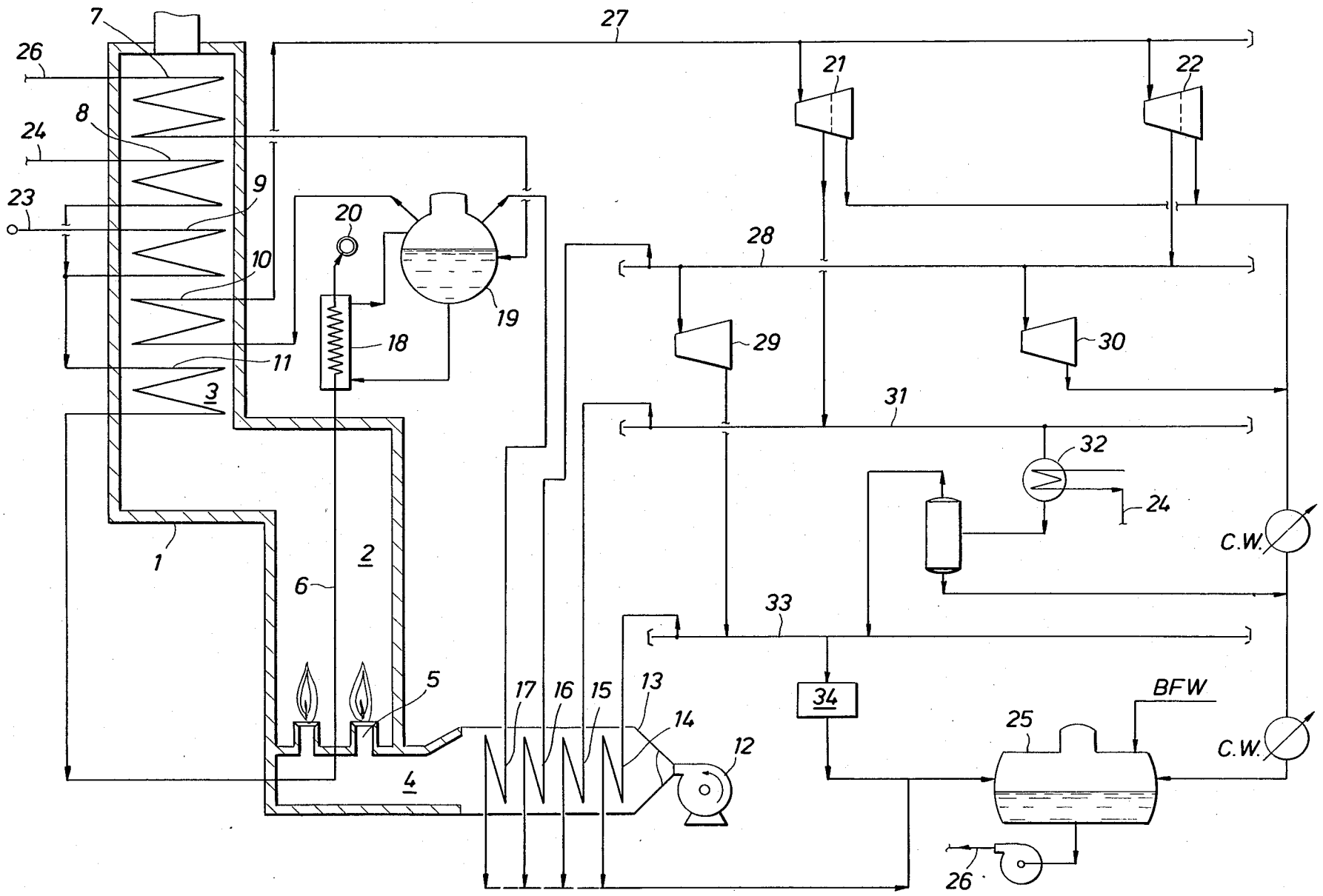
C.W.
C.W.
BFW
22
21
30
32
24
25
26
31
34
33
28
29
27
12
13
14
15
16
17
19
18
20
5
4
2
6
11
9
10
3
1
7
8
26
24
23

COMBUSTION AIR PREHEATING

This invention relates to combustion air preheating for fired tubular furnaces. More particularly, this invention relates to combustion air preheating for steam cracking furnaces employed in the commercial production of ethylene.

The basic process steps for ethylene production are well known and comprise high temperature steam pyrolysis of hydrocarbons ranging from ethane to very heavy gas oil, quenching the resulting cracked gases and then further cooling them, separation of normally liquid hydrocarbons in, typically, a fractionator, compression of cracked gases to about 40 kg/cm$^2$, refrigerating the compressed gases to about −135° C., and multiple expansion of the refrigerated gases through a series of fractionating columns to separate product ethylene and co-products. At least the cracking and primary quenching steps are commonly referred to as the "hot section" of an ethylene production unit.

Steam cracking or pyrolysis furnaces have a radiant section and a convection section. Hydrocarbon feed is customarily preheated in the convection section with waste heat in combustion gas from the radiant section where cracking takes place. Because cracking temperatures are very high, the radiant section not only produces considerable waste heat but, despite good furnace design, also has an inherently low thermal efficiency. In addition to feed preheating, waste heat in the convection section is also recovered by raising high pressure steam for use in turbine drives in downstream sections of the ethylene plant. In contemporary furnace designs, the steam raised is usually in excess of plant requirements and is, therefore, exported. The heat in the exported steam is derived from fuel requirements of the ethylene production process, principally if not entirely the cracking furnace, and is, accordingly, an energy cost penalty.

Process gas and refrigerant compression require significant shaft work that is provided by expansion of high pressure steam typically in the pressure range of 90 to 140 kg/cm$^2$ and superheated typically to between 455° and 540° C. through large, usually multi-stage steam turbines. The turbine exhaust steam is then letdown in pressure through a multiple pressure level steam system which is designed according to the overall heat balance and site requirements. Usually, the steam system will include medium pressure turbines to drive, for example, boiler feed water pumps and blowers. The high pressure steam is raised and superheated variously in the convection section of the furnace, one or more cracked gas quenching steps, a separate boiler, or combinations of these.

Combustion air preheating with waste heat is a well-known technique for reducing furnace fuel consumption since the recovered waste heat represents a direct substitution for fresh fuel. In the instance of high temperature pyrolysis furnaces, greater temperature differences in the radiant section that result from preheated combustion air bring about higher radiant thermal efficiencies and, therefore, less waste heat production. It is known, for example, to supply some shaft work in the process by a gas turbine and use the high temperature exhaust gas to preheat combustion air. A more common source of high level heat is one or more high temperature steam coils in the convection section of the pyrolysis furnace and utilization of that high temperature steam in the combustion air preheater. Such systems are workable but thermally inefficient because the high level heat in excess of process requirements that is used in air preheating is not then available to generate or superheat high pressure steam for turbine drives in process gas and refrigerant compression services. This steam must therefore be supplied from separately fired sources such as an independent boiler. This heat penalty may be overcome to a degree by use of low level heat from various sources as, for example, one or more cooler coils in the convection section of the furnace or heat recovery from the cracked gases fractionator. These systems, as well, are workable but are inherently limited by the temperature of the low level heat source. That is to say, the final preheated air temperature is limited to about 230° C. whereas use of high level heat permits final air preheat temperature to be as high as about 290° C. or higher if superheated steam is used. Further, use of low-level fractionator heat is limited by the amount of pyrolysis oil in the fractionator system which, in turn, is a function of the cracking feedstock. Accordingly, a liquid feed furnace may produce sufficient oil to provide combustion air preheat whereas an equivalent gas feed furnace may not.

It is, therefore, an object of this invention to provide a method for preheating combustion air to relatively high temperature without the thermal penalties associated with use of traditional high level heat sources.

According to the invention, high pressure steam raised in the hot section of an ethylene production process is superheated and at least a portion expanded through a first turbine to produce shaft work and superheated medium pressure steam at a temperature between 260° and 465° C. At least a portion of the superheated medium pressure steam is expanded through a second turbine and exhausts as low pressure steam at a temperature between 120° and 325° C. At least portions of the thus produced low pressure steam and superheated medium pressure steam are employed in preheating combustion air for a tubular steam cracking furnace within the hot section. The first and second turbines will usually be separate machines but may be two turbine stages on a common shaft.

In a preferred embodiment of the invention, the combustion air is supplementally heated by a portion of the high pressure steam which may be saturated or superheated according to choice based on other design parameters for the cracking furnace, quench system, and steam system. We find that excess high level heat in the convection section of the cracking furnace is best reserved for superheating turbine steam and that saturated high pressure steam at a pressure between 90 and 140 kg/cm$^2$ is sufficient to bring the final preheated air temperature to between 260° and 300° C.

On the other hand, system design choices may show good economy by limiting the combustion air preheat sources to turbine exhaust steam at the various levels available in which instance the hottest available source would be the superheated medium pressure steam, preferably within the pressure range from 28 to 70 kg/cm$^2$, which will bring the final air preheat temperature to between 205° and 260° C.

Most preferably, the steam temperatures of the several air preheater coils will, within constraints of good exchanger design, closely approach the air inlet temperatures to the respective coils.

The drawing is a flow scheme for steam cracking hydrocarbons with generation and distribution of steam at multi-pressure levels by an embodiment of the invention wherein portions of steam at various pressure levels are employed for combustion air preheating.

Referring now to the drawing, pyrolysis furnace 1 having a radiant section 2, convection section 3, and combustion air plenum 4 is heated by fuel burners 5. The radiant section contains cracking tubes 6 and convection coils 7, 8, 9, 10, and 11 which are used for feed preheating and steam raising as later described. The furnace is equipped with combustion air blower 12 and a combustion air preheater 13 having coils 14 through 17. The "hot end" system additionally includes primary quench exchangers 18 which are closely coupled to the cracking tubes for the purpose of rapidly cooling cracked gases below their adiabatic cracking temperature. The quench exchangers generate saturated steam from boiler feed water in steam drum 19. Cooled cracked gases from primary quench exchangers 18 are collected in manifold 20 for passage to secondary cooling (not shown). Cracked gases from the secondary cooling step are then fractionated for removal of normally liquid hydrocarbons and the recovered gases are then separated by process gas compression, refrigeration, and fractionation of the cooled high pressure gases. Process gas compression and refrigerant compression are significant energy uses in the overall ethylene production process. Shaft work for these compression services is developed by high pressure steam turbines 21 and 22.

In operation of the hot end, gas oil feed is introduced at 23 to convection coil 9 where it is preheated and then mixed with diluent steam wbich is introduced at 24 and superheated in convection coil 8. The mixed feed is finally heated to incipient cracking temperature in convection coil 11 and introduced to cracking tubes 6.

In order to reduce fuel requirements for the pyrolysis furnace and, therefore, the overall ethylene production process, combustion air introduced at ambient temperature by blower 12 is successively heated by steam coils 14 through 17 in combustion air preheater 13 to a temperature in plenum 4 of 280° C. Combustion gas is then heated by fuel burners 5 to a temperature of 1930° C. in the lower part of radiant section 2. Following heat absorption by cracking tubes 6, the combustion gas enters the convection section 3 at a temperature of 1150° C. and is further cooled to an exhaust temperature of 150° C. by waste heat recovery in the convection section.

Condensate and boiler feedwater from condensate receiver 25 are introduced at high pressure through line 26 to feedwater heating coil 7 in the upper part of the convection section and then to steam drum 19 which is part of the 105 kg/cm$^2$ high pressure steam system. High pressure saturated steam from drum 19 is superheated to 510° C. in convection coil 10 and flows through line 27 for use in two stage turbines 21 and 22.

Steam from the first stage of turbine 22 is exhausted to upper medium pressure steam header 28 at 42 kg/cm$^2$ and 400° C. and is fed to turbines 29 and 30 for further extraction of shaft work. Steam from the first stage of turbine 21 is exhausted to lower medium pressure steam header 31 at 6 kg/cm$^2$ and 205° C. and is fed to dilution steam preheater 32 and other process heating services not shown. Steam is exhausted from turbine 29 to low pressure steam header 33 at 1.4 kg/cm$^2$ and 220° C. and then to miscellaneous process heating services indicated generally at 34.

A portion of the steam from each of the headers 33, 31, and 28 is introduced respectively to coils 14, 15, and 16 in combustion air preheater 13. In alternative steam system designs, all of the turbine exhaust steam in one or more of these headers may be employed in the air preheater. For optimum design, the low temperature coil 14 preheats the cool incoming air and the downstream, successively hotter coils 15 and 16 heat the increasingly warmer air to 210° C. The combustion air is finally preheated to a temperature of 280° C. by coil 17 which employs saturated steam at 105 kg/cm$^2$ from steam drum 19.

Each of the air preheater coils discharges condensate through a pressure letdown system, not shown, to condensate receiver 25. The letdown system comprises a flash pot for each coil outlet from which flash steam is discharged to the inlet of the same coil and condensate is reduced in pressure and introduced to the next lower pressure flash pot and, ultimately, flows to the condensate receiver.

By operation of the system described, $27.7\times10^9$ calories/hour of heat are recovered through the steam system and used for preheating $431\times10^3$ kg/hour of combustion air for furnace 1 to 280° C. This results in a fuel savings relative to an equivalent system not using combustion air preheating of $30.2\times10^9$ calories/hour while still supplying sufficient steam for operation of downstream sections of the ethylene plant.

By comparison, an otherwise equivalent, known system of providing combustion air preheat through direct use of high level heat recovered as steam in the convection section of furnace 1 and quench exchangers 18 provides only $19.9\times10^9$ calories/hour of heat which results in a fuel savings relative, again, to an equivalent system not using combustion air preheating of only $21.7\times10^9$ calories/hour while, again, still supplying sufficient steam for operation of downstream sections of the ethylene plant. In this instance, the combustion air can be heated to only 210° C. because of priority demand for high level heat by the high pressure turbines.

We claim:

1. In a process for steam cracking hydrocarbons to cracked gases in a tubular furnace heated by burning a mixture of fuel and combustion air and subsequently quenching the cracked gases wherein waste heat is recovered in the form of high pressure steam and wherein the combustion air is preheated prior to introduction into the furnace, the improvement which comprises:

(a) superheating the high pressure steam and expanding at least a portion of the superheated high pressure steam through a first turbine to produce shaft work and superheated medium pressure steam at a temperature between 260° and 465° C.;

(b) expanding at least a portion of the superheated medium pressure steam through a second turbine to produce shaft work and low pressure steam at a temperature between 120° and 325° C.; and (c) preheating the combustion air by indirect heat exchange with at least a portion of the superheated medium pressure steam and at least a portion of the low pressure steam.

2. The process of claim 1 wherein the combustion air is preheated by a portion of the high pressure steam.

3. The process of either claim 1 or claim 2 wherein the combustion air is finally preheated to a temperature between 205° and 300° C. prior to introduction to the tubular furnace.

4. The process of either claim 1 or claim 2 wherein the tubular furnace has a convection section and the high pressure steam is superheated in the convection section.

5. The process of either claim 1 or claim 2 wherein the high pressure steam is at a pressure between 90 and 140 kg/cm$^2$ and the superheated medium pressure steam is at a pressure between 28 to 70 kg/cm$^2$.

6. The process of either claim 1 or claim 2 wherein the high pressure steam is raised by indirect heat exchange with the cracked gases.

* * * * *